US011007802B2

(12) United States Patent
Sekikawa

(10) Patent No.: US 11,007,802 B2
(45) Date of Patent: May 18, 2021

(54) LIQUID DISCHARGE APPARATUS

(71) Applicant: Takeshi Sekikawa, Kanagawa (JP)

(72) Inventor: Takeshi Sekikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/742,715

(22) Filed: Jan. 14, 2020

(65) Prior Publication Data

US 2020/0247154 A1 Aug. 6, 2020

(30) Foreign Application Priority Data

Jan. 31, 2019 (JP) ..... JP2019-015161

(51) Int. Cl.
*B41J 25/00* (2006.01)
*B41J 29/02* (2006.01)

(52) U.S. Cl.
CPC ..... *B41J 25/001* (2013.01)

(58) Field of Classification Search
CPC ..... B41J 25/001; B41J 29/02
See application file for complete search history.

(56) References Cited

U.S. PATENT DOCUMENTS

2006/0192833 A1* 8/2006 Samoto ..... B41J 19/005 347/108
2010/0231643 A1 9/2010 Saiga et al.
2011/0134190 A1 6/2011 Mase et al.
2011/0205299 A1 8/2011 Naruse et al.
2018/0311983 A1 11/2018 Saiga

FOREIGN PATENT DOCUMENTS

JP 2007-144905 6/2007
JP 2011-230416 11/2011
JP 2012-179728 9/2012
JP 2014-208429 11/2014

* cited by examiner

*Primary Examiner* — Matthew Luu
*Assistant Examiner* — Kendrick X Liu
(74) *Attorney, Agent, or Firm* — Duft & Bornsen, PC

(57) ABSTRACT

A liquid discharge apparatus includes a liquid discharge head configured to discharge a liquid, a carriage configured to movably hold the liquid discharge head, an attachment part displaceably attached to the carriage, and a holder connected to the attachment part. The holder holds at least one of a cable and a tube connected to the liquid discharge head.

7 Claims, 15 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-015161, filed on Jan. 31, 2019 in the Japan Patent Office, the entire disclosure of which is hereby incorporated by reference herein.

BACKGROUND

Technical Field

Aspects of the present disclosure relate to a liquid discharge apparatus.

Related Art

A liquid discharge apparatus includes a carriage on which a liquid discharge head to discharge a liquid is mounted. The apparatus includes a tube to supply the liquid to the liquid discharge head mounted on the carriage, a power supply to drive the liquid discharge head, and a cable or harness to supply signals to the liquid discharge head. The tube, the power supply, and the cable or harness are connected to the liquid discharge head.

A liquid discharge apparatus includes a liquid tube and a tube holder. One end of the liquid tube is connected to a liquid-supply source, and another end of the liquid tube is connected to the liquid discharge head at a leading end of the carriage via a U-shaped reversing portion. The tube holder holds the liquid tube. The tube holder is fixed to the leading end of the carriage.

SUMMARY

In an aspect of this disclosure, a liquid discharge apparatus is provided that includes a liquid discharge head configured to discharge a liquid, a carriage configured to movably hold the liquid discharge head, an attachment part displaceably attached to the carriage, and a holder connected to the attachment part. The holder holds at least one of a cable and a tube connected to the liquid discharge head.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
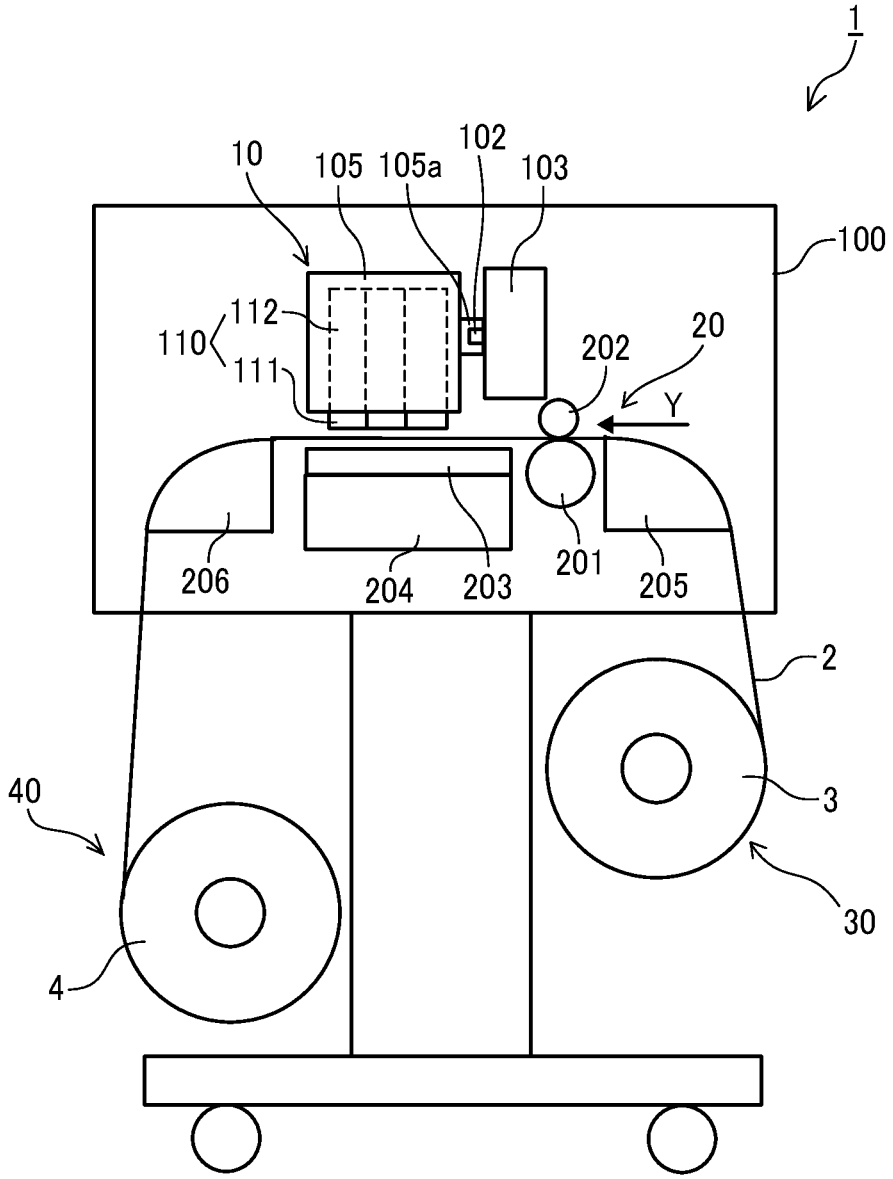
FIG. 1 is a side view of an example of a mechanism of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below. First, a printer 1 according to an embodiment of the present disclosure is described with reference to FIGS. 1 to 3. FIG. 1 is a cross-sectional side view of the printer 1 according to the present embodiment.

Figure 2:
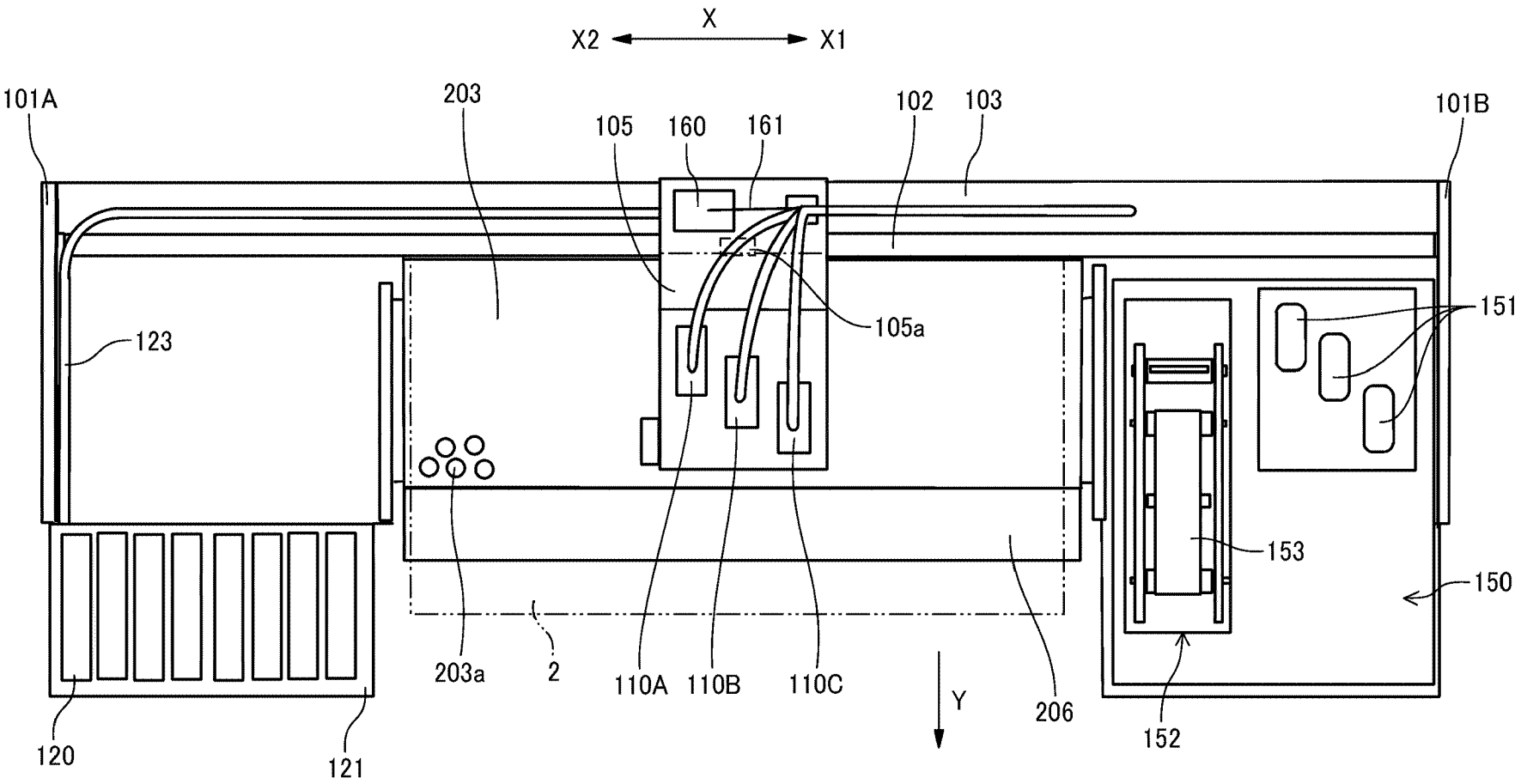
FIG. 2 is a plan view of the printer of FIG. 1.
Figure 3:
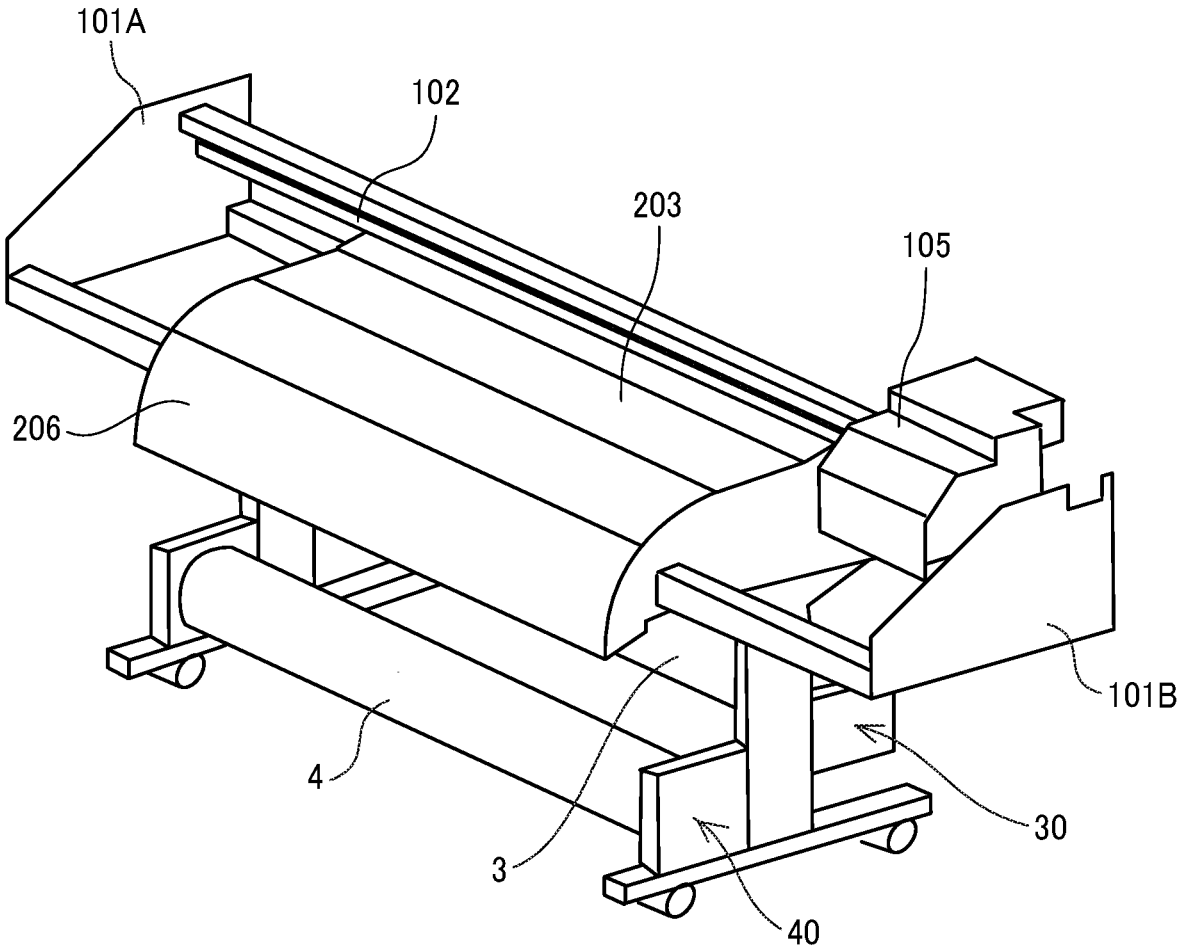
FIG. 3 is a schematic perspective view of a portion of the printer of FIG. 1.

FIG. 2 is a plan view of the printer 1 of FIG. 1. FIG. 3 is a schematic perspective view of a portion of the printer 1 in the present embodiment.

The printer 1 is a serial-type inkjet recording apparatus as a liquid discharge apparatus. The printer 1 includes a printing unit 10 and a conveyor 20 in an apparatus body 100. The printing unit 10 prints on a sheet 2 such as a roll paper. The conveyor 20 conveys the sheet 2. Further, the printer 1 includes a roll feeder 30 and a roll winder 40 outside the apparatus body 100. The roll feeder 30 accommodates a feeding roll 3 in which the sheet 2 is wound in a roll shape and feeds the sheet 2 to the printing unit 10. The roll winder 40 accommodates a winding roll 4 in which the sheet 2, onto which an image is printed by the printing unit 10, is wound. The sheet 2 is wound in a roll shape in the winding roll 4.

The printing unit 10 reciprocally movably hold the carriage 105 as a movable body in a main-scanning direction indicated by arrow "X". The main-scanning direction includes an X1 direction directed toward a right side in FIG. 2 and an X2 direction directed toward a left side in FIG. 2. The guide 102 is attached to a stay 103 bridged between a left-side plate 101A and a right-side plate 101B. The carriage 105 is fitted to the guide 102 so that a fitting portion 105*a* formed on a back side of the carriage 105 is movably fitted to the guide 102.

Three liquid discharge devices 110 (110A to 110C) are mounted on the carriage 105. The liquid discharge device 110 includes a liquid discharge head 111 as a liquid discharge device and a sub tank 112 that supplies liquid to the liquid discharge head 111. Hereinafter, the "liquid discharge head" is simply referred to as the "head". The liquid discharge device 110 includes the head 111 and the sub tank 112 formed as a single body. The head 111 discharges a liquid onto a medium on which the liquid is adhered such as a sheet of paper.

The printer 1 includes a cartridge holder 121 to which a plurality of main tanks 120 (liquid cartridges) containing liquids of respective colors are replaceably mounted on one end of the apparatus body 100. The cartridge holder 121 includes a liquid feed pump, etc., to supply liquid of the respective colors from the main tanks 120 to the heads 111 of the liquid discharge devices 110 via supply tubes 123 of respective colors. The main tanks 120 are mounted on the cartridge holder 121.

Further, the carriage 105 mounts a relay board 160 connected to a control board on the apparatus body 100 via a flexible cable 161. Thus, power and signals to driving the head 111 are transferred to the relay board 160.

The conveyor 20 includes a conveyance roller 201 and a counter roller 202 as a conveyance device on an upstream of the printing unit 10 in a sheet conveyance direction as indicated by arrow "Y". The conveyor 20 sandwiches the sheet 2 with the conveyance roller 201 and the counter roller 202 to convey the sheet 2 in the sheet conveyance direction Y.

The conveyor 20 includes a platen 203 and a suction mechanism 204 (see FIG. 1). The platen 203 faces the head 111 to guide a sheet 2. The suction mechanism 204 attracts the sheet 2 through suction holes 203*a* of the platen 203. Although a portion of the suction holes 203*a* is illustrated in FIG. 2, the platen 203 includes suction holes 203*a* formed all over an entire surface of the platen 203.

The conveyor 20 includes a conveyance guide 205 on an entrance side (right-side in FIG. 1) of the conveyor 20. The conveyance guide 205 guides, to the printing unit 10, the sheet 2 fed from the feeding roll 3. The conveyor 20 further includes a conveyance guide 206 on an exit side (left-side in FIG. 1) of the conveyor 20. The conveyance guide 206 guides, to the winding roll 4, the sheet 2 on which an image is printed by the printing unit 10.

The printer 1 includes a maintenance unit 150 to maintain and recover a discharge function the head 111. The maintenance unit 150 is disposed on one side (right-side in FIGS. 2 and 3) of the printer 1 in the main-scanning direction X of the carriage 105.

The maintenance unit 150 includes, for example, a wiper 152 including a cap 151 to cap a nozzle surface of the head 111 and a web 153 to wipe the nozzle surface of the head 111.

In the printer 1, the conveyance roller 201 and the counter roller 202 conveys the sheet 2 in a conveyance direction indicated by arrow Y in FIG. 2 while the sheet 2 is attracted to the platen 203.

The head 111 is driven in response to print signals while the carriage 105 moves in the main-scanning direction X, to discharge the liquid of a desired color to the sheet 2 stopped, thus printing one line of an image on the sheet 2. Then, the sheet 2 is fed by a predetermined distance to print next line of the image. The above-described operations of feeding and printing are repeated to form a desired image on the sheet 2, and then the sheet 2 is ejected to the winding roll 4.

Figure 4:
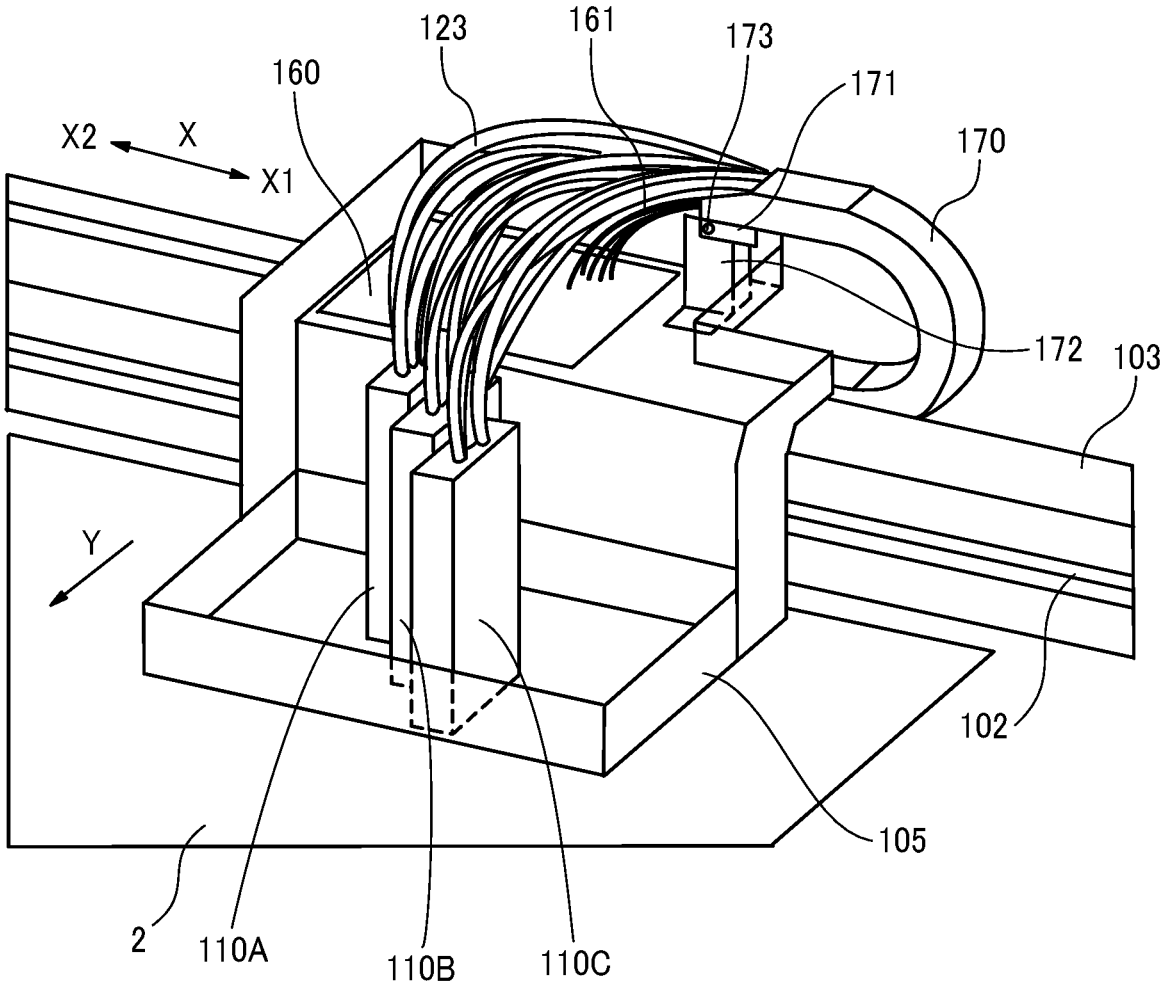
FIG. 4 is a perspective view of a carriage illustrating a mounting structure (coupling structure) of a holder of tubes and cables to the carriage in a first embodiment of the present disclosure.
Figure 5:
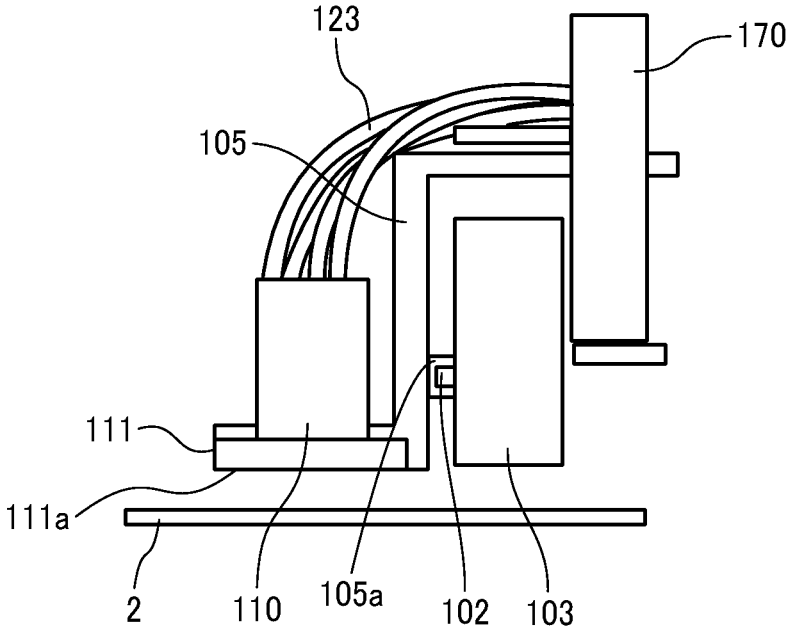
FIG. 5 is a schematic side view of the mounting structure of the printer in the first embodiment.

Next, a mounting structure (coupling structure) of a holder of tubes and cables holder to the carriage 105 according to a first embodiment of the present disclosure is described with reference to FIGS. 4 to 6. FIG. 4 is a perspective view of a carriage portion according to the first embodiment of the present disclosure. FIG. 5 is a side view of the carriage portion according to the first embodiment of the present disclosure. FIG. 6 is a front view of the carriage portion according to the first embodiment of the present disclosure.

The printer 1 according to the present embodiment includes a plurality of supply tubes 123 and a plurality of flexible cables 161 housed and held in a cable carrier 170 as a holder. The plurality of supply tubes 123 and the plurality of flexible cables 161 housed in the cable carrier 170 are arranged between the liquid discharge devices 110A to 110C and the relay board 160.

The cable carrier 170 includes an attachment bracket 171 at a tip of the cable carrier 170. The attachment bracket 171 is attached to the carriage 105. Further, the carriage 105 includes a support 172 to connect the attachment bracket 171 of the cable carrier 170 and the carriage 105 on an upper surface of the carriage 105.

The attachment bracket 171 is an attachment part of the cable carrier 170 to the carriage 105. The attachment bracket 171 is displaceably (here, rotatably) attached to the support 172 of the carriage 105 by the support shaft 173. The attachment bracket 171 rotates around the support shaft 173 with a deformation of the cable carrier 170 that is deformed according to a movement of the carriage 105.

Figure 6A:
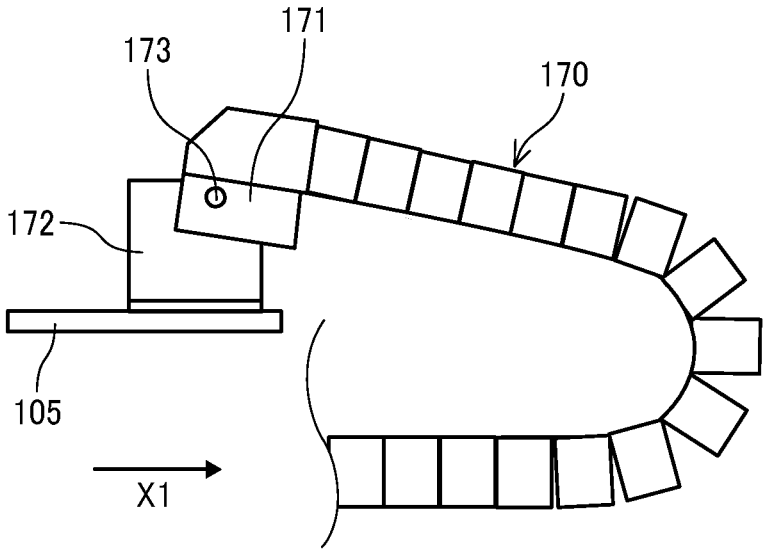
FIGS. 6A and 6B are front views of the mounting structure of the printer in the first embodiment.
Figure 6B:
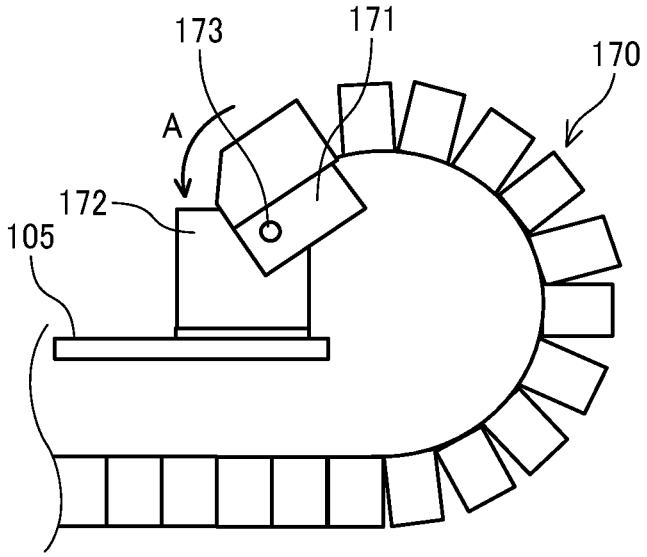

With the above-described configuration, as illustrated in FIGS. 6A and 6B, the attachment bracket 171 of the cable carrier 170 rotates around a support shaft 173 in a direction indicated by arrow "A" when the carriage 105 moves in a direction indicated by arrow "X1".

Thus, the cable carrier 170 deforms to press the carriage 105 downward, and no force is applied to the carriage 105 in a direction raising the carriage 105.

Thus, the printer 1 can stably perform printing without change in a posture of the carriage 105.

Figure 7A:
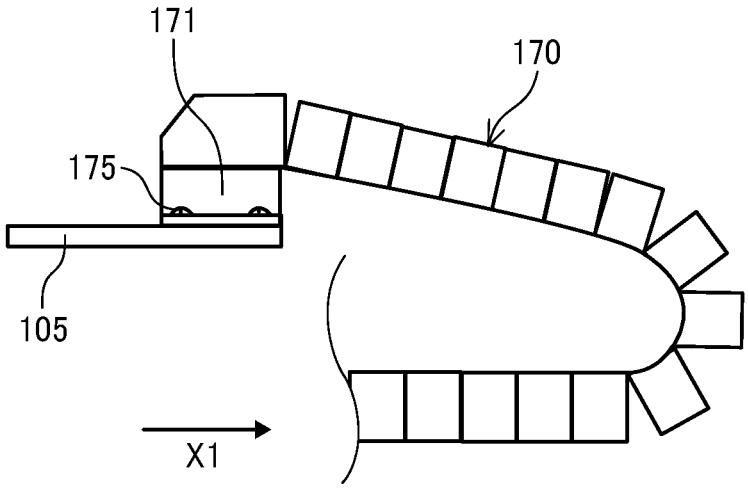
FIGS. 7A and 7B are front views of a mounting structure (coupling structure) of a holder of tubes and cables to the carriage 105 according to Comparative Example 1.
Figure 7B:
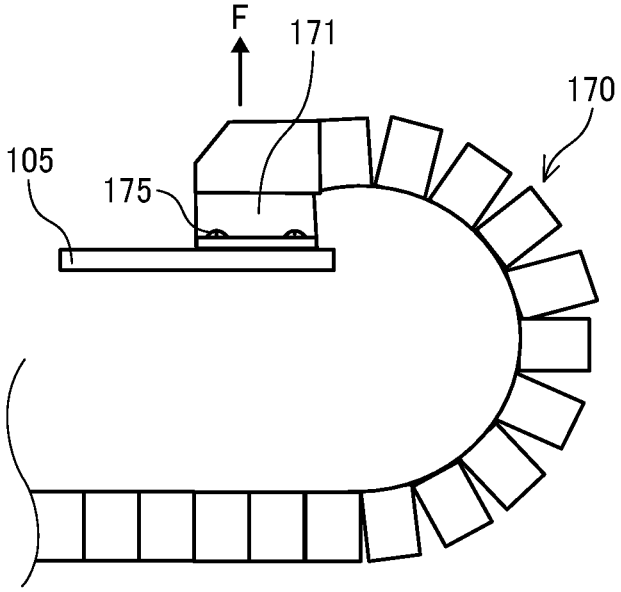
Figure 8:
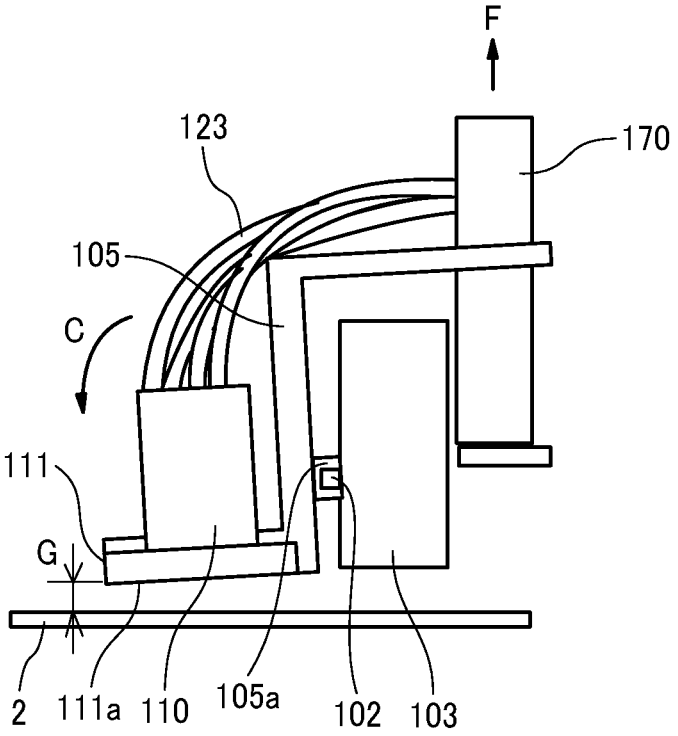
FIG. 8 is a schematic side view of the mounting structure of the printer in the Comparative Example 1.

A Comparative Example 1 is illustrated with reference to FIGS. 7A and 7B, and FIG. 8. FIGS. 7A and 7B are front views of a mounting structure (coupling structure) of a holder of tubes and cables to the carriage 105 according to the Comparative Example 1. FIG. 8 is a side view of the carriage 105 according to the Comparative Example 1 of the present embodiment.

In Comparative Example 1, a cable carrier 170 houses and holds a plurality of supply tubes 123 and a flexible cables 161. Further, the cable carrier 170 includes an attachment bracket 171 at a leading end of the cable carrier 170. The attachment bracket 171 is fixed to an upper surface of the carriage 105 with fastener 175.

In the configuration of Comparative Example 1, the attachment bracket 171 of the cable carrier 170 may not rotate when the carriage 105 moves in the direction indicated by arrow X1 as illustrated in FIG. 7A.

Thus, a reaction force is generated by a restoration force of the supply tubes 123 and the flexible cables 161 housed inside the cable carrier 170 when the cable carrier 170 is bent. The reaction force generates a force F to lift the attachment bracket 171 of the cable carrier 170.

Thus, as illustrated in FIG. 8, a force F to lift the carriage 105 acts on the carriage 105 to rotationally displace the carriage 105 in a direction indicated by arrow "C" to cause the change of the posture of the carriage 105. Thus, a gap G between the head 111 of the liquid discharge device 110 and the sheet 2 varies along a nozzle surface 111*a* of the head 111. Thus, the gap G varies by a position of the carriage 105 in the main-scanning direction X of the carriage 105. Further, the gap G may become different between an upstream and a downstream in the conveyance direction Y. Variation in the gap G causes deterioration of a print quality of the printer 1.

Conversely, the printer 1 according to a configuration of the present embodiment can reduce the variation in the gap G due to the change in the posture of the carriage 105 since the lifting force F does not act on the carriage 105. Thus, the printer 1 according to the first embodiment can stably prints with high quality.

Figure 9:
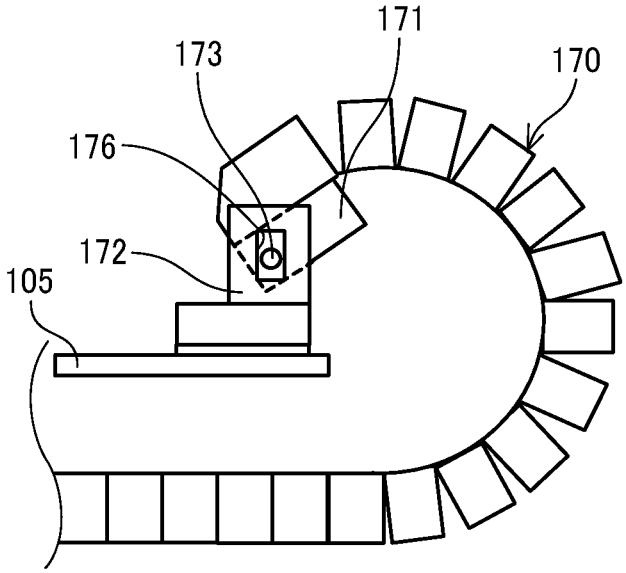
FIG. 9 is a front view of a carriage illustrating a mounting structure (coupling structure) of a holder of tubes and cables to the carriage according to a second embodiment of the present embodiment.

Next, a mounting structure of the holder of the tubes and cables to the carriage in a second embodiment of the present disclosure is described with reference to FIGS. 9 and 10. FIG. 9 is a front view of the carriage 105 according to the second embodiment. FIG. 10 is a partial cross-sectional side view of the carriage according to the second embodiment.

The printer 1 according to the second embodiment includes a vertical slot 176 in the support 172 on the carriage 105. The support shaft 173 of the attachment bracket 171 of the cable carrier 170 is movably fitted in the vertical slot 176. Thus, the attachment bracket 171 is vertically movable with respect to the support 172 of the carriage 105.

Figure 10A:
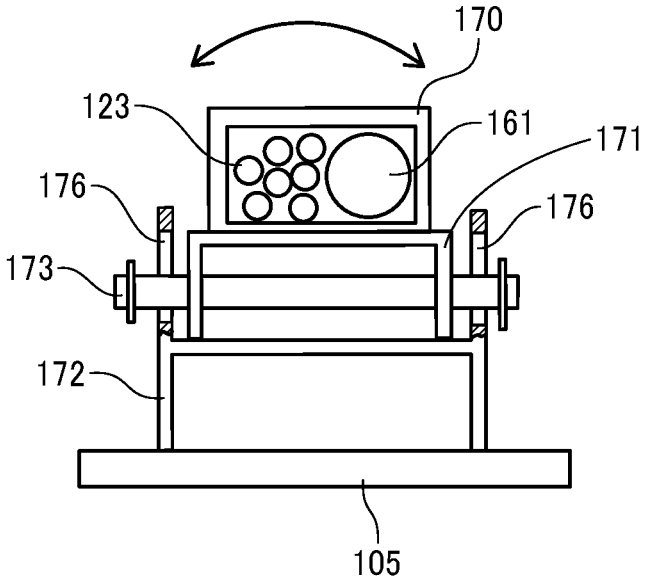
FIGS. 10A and 10B are partial cross-sectional side views of the carriage and the mounting structure according to the second embodiment.
Figure 10B:
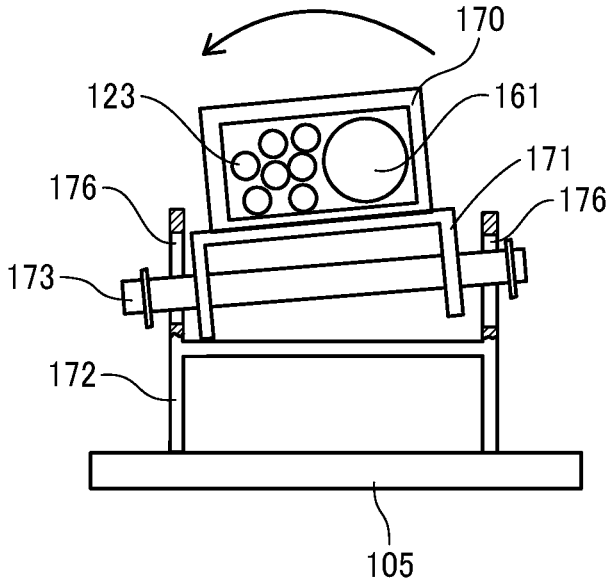

Since the printer 1 is thus configured, the attachment bracket 171 of the cable carrier 170 is rotatably displaceable in a direction indicated by arrow in a plane perpendicular to the main-scanning direction X as illustrated in FIGS. 10A and 10B.

Thus, the printer 1 can prevent application of a force generated by a twist of the cable carrier 170 on the carriage 105.

When there is a deviation in a stiffness of the supply tube 123 and the flexible cable 161 housed in the cable carrier 170, one side (right side in FIG. 10B) of the cable carrier 170 may be lifted that cause a twist of the cable carrier 170.

If the support shaft 173 is fixed in the vertical direction, the attachment bracket 171 may not be tilted (inclined). Thus, a force in a twist direction of the cable carrier 170 may act on the carriage 105 to change the posture of the carriage 105.

Conversely, the printer 1 according to the present embodiment includes the support 172 that vertically movably supports the support shaft 173. As illustrated in FIGS. 10A and 10B, the attachment bracket 171 can be tilted (inclined), for example, in a direction indicated by arrow in FIGS. 10A and 10B according to the twist of the cable carrier 170.

Thus, the printer 1 can prevent application of a force generated by a twist of the cable carrier 170 on the carriage 105. Thus, the printer 1 can stably perform printing without a change in a posture of the carriage 105.

Figure 11:
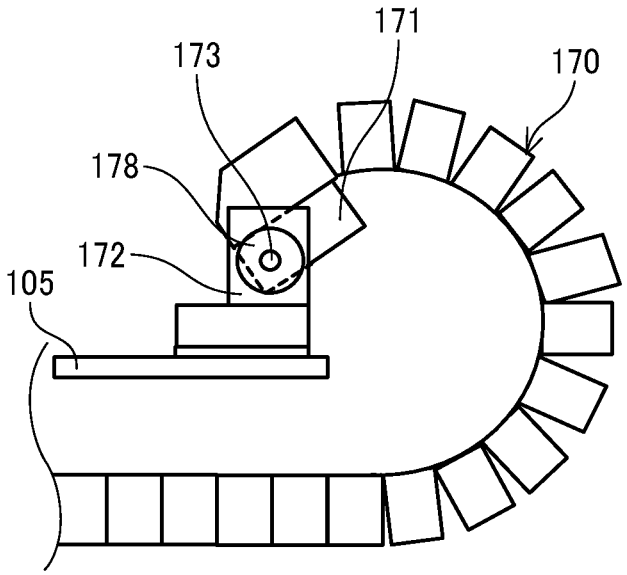
FIG. 11 is a front view of a carriage illustrating a mounting structure (coupling structure) of a holder of tubes and cables to the carriage according to a third embodiment of the present disclosure.
Figure 12:
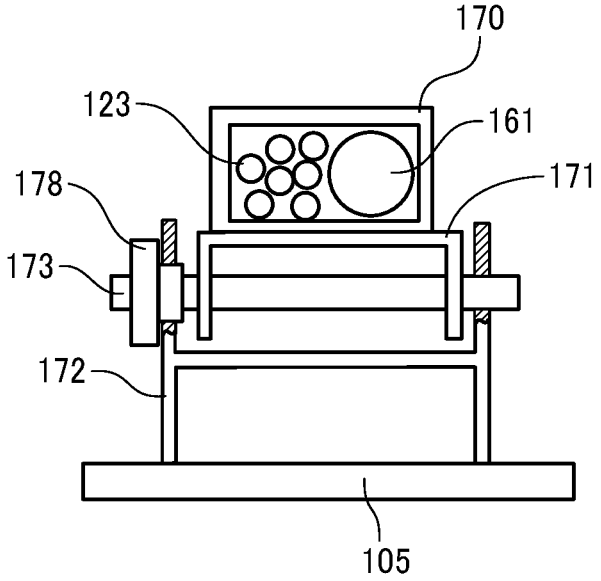
FIG. 12 is a partial cross-sectional side view of the carriage and the mounting structure according to the third embodiment.

Next, a mounting structure of the holder of the tubes and cables to the carriage in a third embodiment of the present disclosure is described with reference to FIGS. 11 and 12. FIG. 11 is a front view of the carriage 105 according to the third embodiment. FIG. 12 is a partial cross-sectional side view of the carriage 105 according to the third embodiment.

The printer 1 according to the third embodiment includes a torque limiter 178 on the support shaft 173 of the attachment bracket 171 of the cable carrier 170. The torque limiter 178 functions as a damper to damp a force acting on the attachment bracket 171.

Figure 13A:
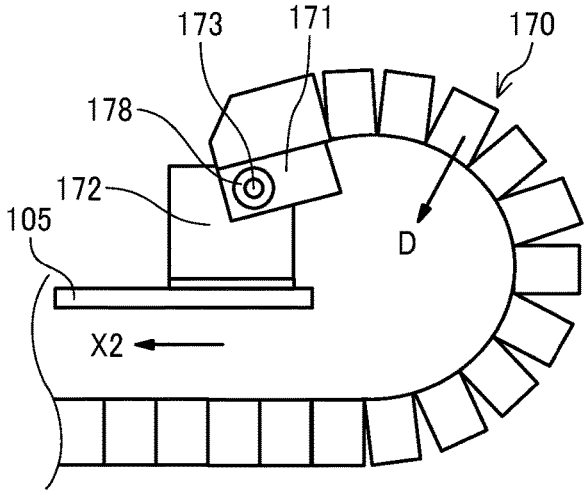
FIGS. 13A to 13C are front views illustrating a change in posture of the cable carrier according to the third embodiment.
Figure 13B:
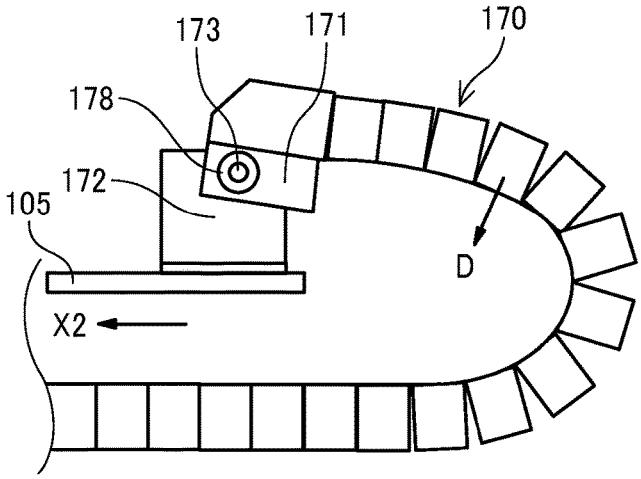
Figure 13C:
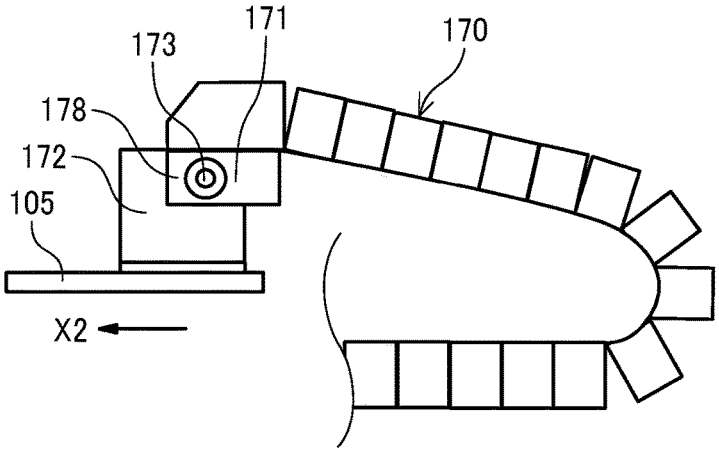
Figure 14A:
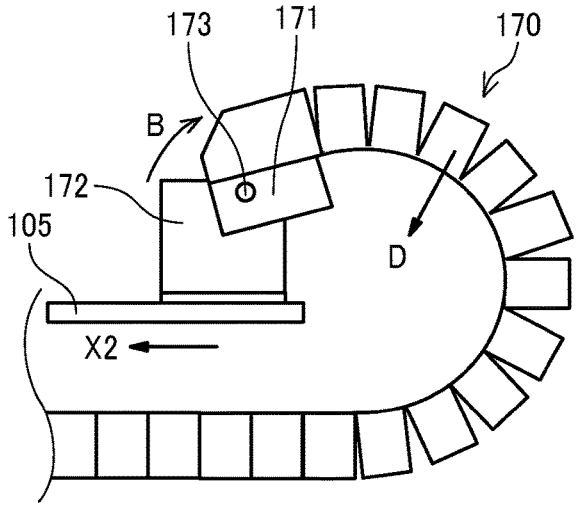
FIGS. 14A to 14C are front views illustrating a change in posture of the cable carrier in a printer not including the torque limiter.
Figure 14B:
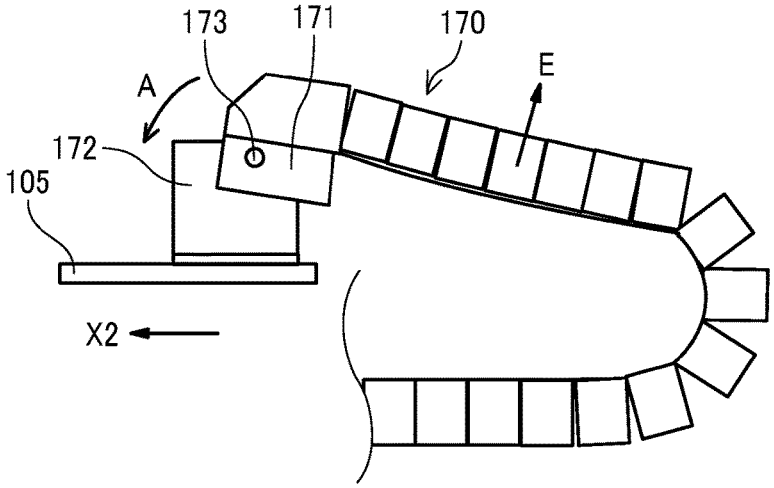
Figure 14C:
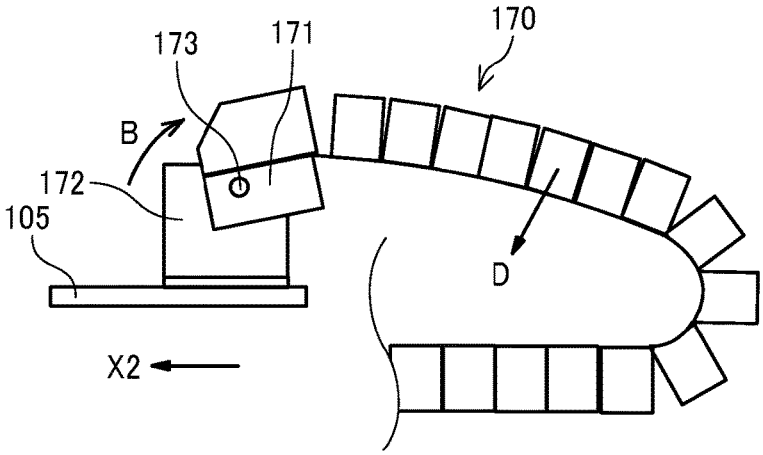

Next, an effect of the torque limiter 178 according to the present embodiment is illustrated with reference to FIGS. 13A to 13B, and FIGS. 14A to 14B. FIGS. 13A to 13C are front views illustrating a change in posture of the cable carrier 170 according to the third embodiment. FIGS. 14A to 14C are front views illustrating a change in posture of the cable carrier in a printer not including the torque limiter 178.

First, as illustrated in FIG. 14A, in a configuration in which the printer does not include the torque limiter 178 according to the third embodiment, the carriage 105 is moved toward the direction indicated by arrow X2 from a state in which the cable carrier 170 is extended and curved. Then, as illustrated in FIGS. 14B and 14C, the posture of the cable carrier 170 changes such that the cable carrier 170 contracts, that is, a folding length of the cable carrier 170 increases.

Here, if the support shaft 173 of the attachment bracket 171 of the cable carrier 170 does not include the torque limiter 178, the support shaft 173 can freely rotate (rotatable in each directions indicated by arrow A and arrow B).

Therefore, as the carriage 105 moves in the direction indicated by arrow X2, the cable carrier 170 moves in a direction (downward) indicated by arrow D in FIG. 14A, for example. Further, as illustrated in FIG. 14B, the cable carrier 170 rebounds and moves upward in a direction indicated by arrow E. Further, as illustrated in FIG. 14C, the cable carrier 170 moves downward again in the direction indicated by arrow D.

As described above, if the support shaft 173 of the attachment bracket 171 of the cable carrier 170 does not include the torque limiter 178, the cable carrier 170 may bounce up and down that may apply impact on the carriage 105.

Conversely, the printer 1 according to the present embodiment includes the torque limiter 178 on the support shaft 173 of the attachment bracket 171 of the cable carrier 170. Thus, the torque limiter 178 can apply load on a rotation of the support shaft 173 in the direction indicated by arrow B.

Thus, as illustrated in FIGS. 13A to 13C, the cable carrier 170 moves downward in the direction indicated by arrow D when the carriage 105 moves in the direction indicated by arrow X2. Thus, the printer 1 can reduce a bounce of the cable carrier 170 and further stabilize the posture of the carriage 105.

Figure 15:
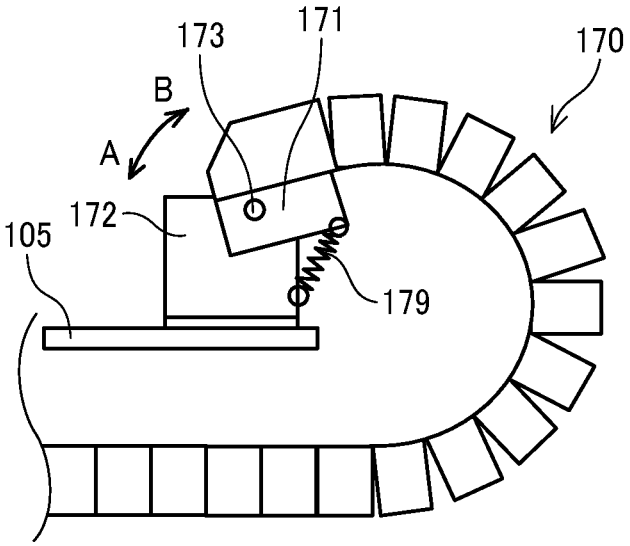
FIG. 15 is a front view of a carriage illustrating a mounting structure (coupling structure) of a holder of tubes and cables to the carriage according to a fourth embodiment of the present disclosure.

Next, a mounting structure of the holder of the tubes and cables to the carriage 105 in a fourth embodiment of the present disclosure is described with reference to FIGS. 15 and 16. FIG. 15 is a front view of the carriage 105 according to the fourth embodiment. FIGS. 16A and 16B are front views of the carriage 105 illustrating an effect of the fourth embodiment.

The printer 1 according to the fourth embodiment includes a tension coil spring 179 as an elastic member between the attachment bracket 171 of the cable carrier 170 and the support 172. The tension coil spring 179 as the elastic member functions as a tension part to pull the attachment bracket 171 in a direction in which a curved portion of the cable carrier 170 is pulled downward toward the support 172 as illustrated in FIG. 16A. Thus, the tension coil spring 179 pulls the attachment bracket 171 toward the support 172.

Figure 16B:
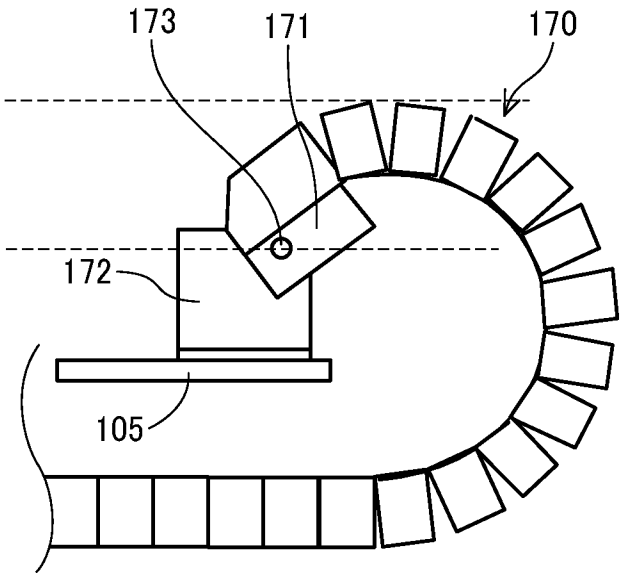
FIGS. 16A and 16B are front views of the carriage and the mounting structure illustrating an effect of the fourth embodiment.
Figure 16A:
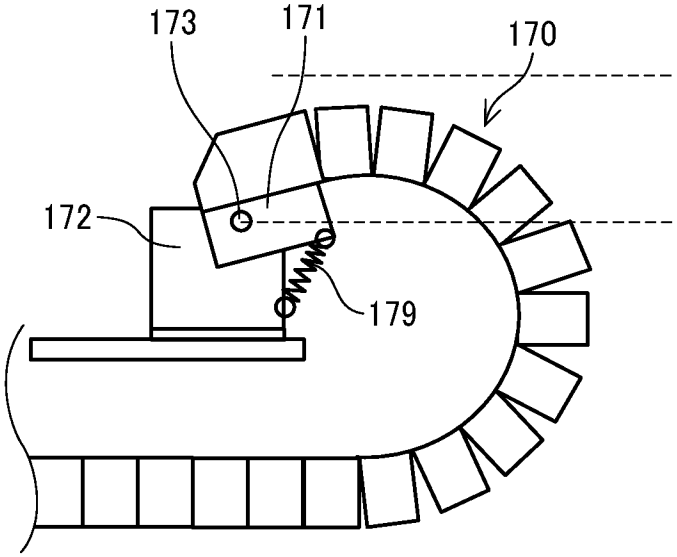

Thus, the printer 1 including the tension coil spring 179 as illustrated in FIG. 16A can reduce a bulge of the cable carrier 170 as compared with a configuration in FIG. 16B that does not include the tension coil spring 179.

As a number of tubes and cables increases, the stiffness of the tubes and cables increases. Thus, the bulge of the cable carrier 170 increases, and vertical vibration of the carriage 105 during a movement of the carriage 105 increases.

Thus, the printer 1 includes the elastic member such as the tension coil spring 179 to pull the cable carrier 170 toward the support 120 as in the present embodiment. Thus, the elastic member (the tension coil spring 179) can reduce the bulge of the cable carrier 170 and reduce the vertical vibration generated by the movement of the carriage 105.

Figure 17:
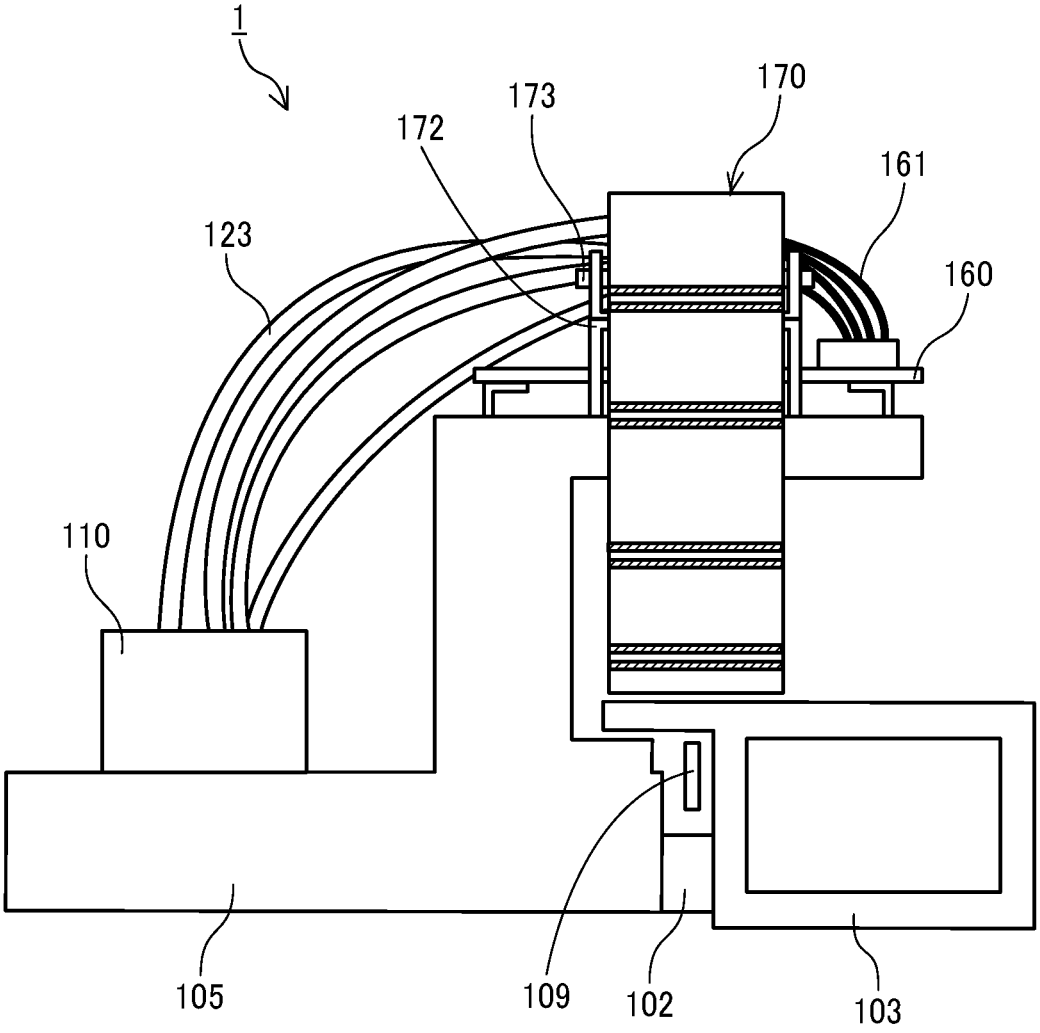
FIG. 17 is a side view of a carriage and a mounting structure according to a fifth embodiment of the present disclosure.

Next, a mounting structure of the holder of the tubes and cables to the carriage 105 in a fifth embodiment in the present disclosure is described with reference to FIG. 17. FIG. 17 is a side view of the printer 1 according to the fifth embodiment of the present disclosure.

The carriage 105 includes the support 172 that connects the cable carrier 170 and the carriage 105. The support 172 is disposed above the guide 102. The carriage 105 is movably scanned in the main-scanning direction X via the timing belt 109.

Thus, the printer 1 can prevent application of a moment on the carriage 105 and reduce the vibration of the cable carrier 170.

In each of the above embodiments, the attachment part (attachment bracket 171) of the holder (cable carrier 170) is rotatably attached to the movable body (carriage 105). Thus, the attachment part (attachment bracket 171) of the holder (cable carrier 170) is displaceably attached (mounted) to the movable body (carriage 105).

However, the printer 1 according to the present embodiment is not limited to the embodiments as described above.

For example, the attachment part (attachment bracket 171) may be attached to the support 172 of the movable body (carriage 105) with an elastic member (tension coil spring 179).

Further, instead of a configuration illustrated in FIG. 9, a groove having vertical slot shape may be formed on one of the support 172 and the attachment part (attachment bracket 171), and a convex portion may be formed on another of the support 172 and the attachment part (attachment bracket 171). Thus, the attachment part (attachment bracket 171) slides relative to the support 172 along the groove according to a movement of the movable body (carriage 105).

Further, in each of the above embodiments, an example of the holder (cable carrier 170) that houses the tube and the cable (harness) has been described. However, the printer 1 according to the present embodiment may further include a configuration in which the holder housing one of the tube and the cable (harness) is attached to the movable body (carriage 105).

In each of the above-described embodiments, the carriage 105, on which the head 111 of the printer 1 is mounted, is described as a movable body. However, the movable body is not limited to the carriage 105. For example, the present embodiments may be similarly applied to an apparatus that guides a reader of an image reading apparatus as a movable body.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head configured to discharge a liquid in a vertical direction;

a carriage configured to movably hold the liquid discharge head, and to move along a horizontal direction;

a support member extending upward in the vertical direction from the carriage, wherein the support member includes a vertical slot;

a support shaft disposed within the vertical slot;

an attachment part connected to the support shaft and configured to move along the vertical slot in the vertical direction with respect to the carriage; and a holder connected to the attachment part, the holder configured to hold at least one of a cable and a tube connected to the liquid discharge head.

2. The liquid discharge apparatus according to claim 1, wherein the attachment part is rotatably attached to the carriage.

3. The liquid discharge apparatus according to claim 1, wherein the attachment part is vertically movable with respect to the carriage.

4. The liquid discharge apparatus according to claim 1, further comprising a guide movably holding the carriage, wherein the attachment part is disposed above the guide.

5. The liquid discharge apparatus according to claim 1, wherein the attachment part includes a damper configured to damp a force acting on the attachment part.

6. The liquid discharge apparatus according to claim 5, wherein the damper is a torque limiter.

7. The liquid discharge apparatus according to claim 1, further comprising:

a tension part connecting the attachment part and the carriage, wherein the tension part pulls the attachment part toward the carriage.

* * * * *